US007290417B1

(12) United States Patent
Huang

(10) Patent No.: US 7,290,417 B1
(45) Date of Patent: Nov. 6, 2007

(54) SUITCASE LOCK THAT CAN BE OPENED EITHER BY SETTING A COMBINATION OR BY A KEY

(76) Inventor: Chien-Yung Huang, No.189, Hann Shen E. Road, Banchiao City, Taipei Hsien (TW)

( * ) Notice: Subject to any disclaimer, the term of this patent is extended or adjusted under 35 U.S.C. 154(b) by 0 days.

(21) Appl. No.: 11/642,461

(22) Filed: Dec. 19, 2006

(30) Foreign Application Priority Data

Feb. 22, 2006 (TW) ..... 95105935 A

(51) Int. Cl.
*E05B 37/00* (2006.01)

(52) U.S. Cl. ..... 70/285; 70/69; 70/DIG. 71

(58) Field of Classification Search ..... 70/284, 70/285, 69–76, 312–315, 318, DIG. 71
See application file for complete search history.

(56) References Cited

U.S. PATENT DOCUMENTS

| | | | | | |
|---|---|---|---|---|---|
| 3,408,839 | A * | 11/1968 | Walters | ..... | 70/285 |
| 3,677,042 | A * | 7/1972 | Atkinson | ..... | 70/312 |
| 4,366,687 | A * | 1/1983 | Atkinson | ..... | 70/312 |
| 4,520,641 | A * | 6/1985 | Bako | ..... | 70/312 |
| 4,557,122 | A * | 12/1985 | Hwang | ..... | 70/284 |
| 4,671,088 | A * | 6/1987 | Jeang | ..... | 70/284 |
| 5,237,842 | A * | 8/1993 | Rasch et al. | ..... | 70/285 |
| 5,345,798 | A * | 9/1994 | Nakai | ..... | 70/284 |
| 5,661,991 | A * | 9/1997 | Hsu | ..... | 70/312 |
| 6,568,225 | B1 * | 5/2003 | Chang | ..... | 70/69 |
| 6,598,434 | B2 * | 7/2003 | Yang | ..... | 70/284 |
| 2004/0011098 | A1 * | 1/2004 | Yang | ..... | 70/284 |

* cited by examiner

*Primary Examiner*—Jennifer H. Gay
*Assistant Examiner*—Christopher Boswell
(74) *Attorney, Agent, or Firm*—Pro-Techtor Int'l Services

(57) ABSTRACT

A suitcase lock that can be opened either by setting a combination or by a key, in which dials of a suitcase lock are disposed with sleeves, and characterized in that a key tumbler is additionally fitted to the suitcase lock, and tongues located at a lower portion of a swing plate clamp connect to a slider. A groove at one end of the slider enables a push rod of the key tumbler to be clamped therein, and sloping grooves defined on another end enable the tongues of the swing plate to displace therein. In general, dials are used to control cuttings or circular arcs on the sleeves to operate the swing plate and hooking to a locked object and realize opening and closing of the lock. However, when in a locked state, without moving the dials, a key can be used to directly activate the key tumbler to push the slider, and thereby causes the swing plate to tilt in an opposite direction and the stopper at one end of swing plate can release the locked object from hooking position, thus opening the lock or suitcase.

5 Claims, 5 Drawing Sheets

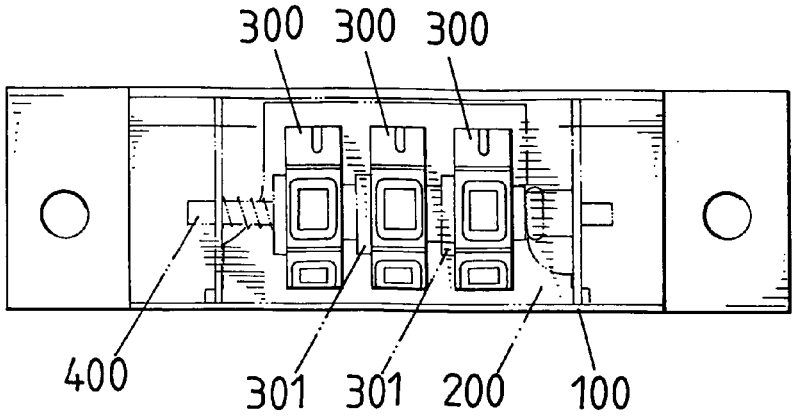
FIG.1
(PRIOR ART)
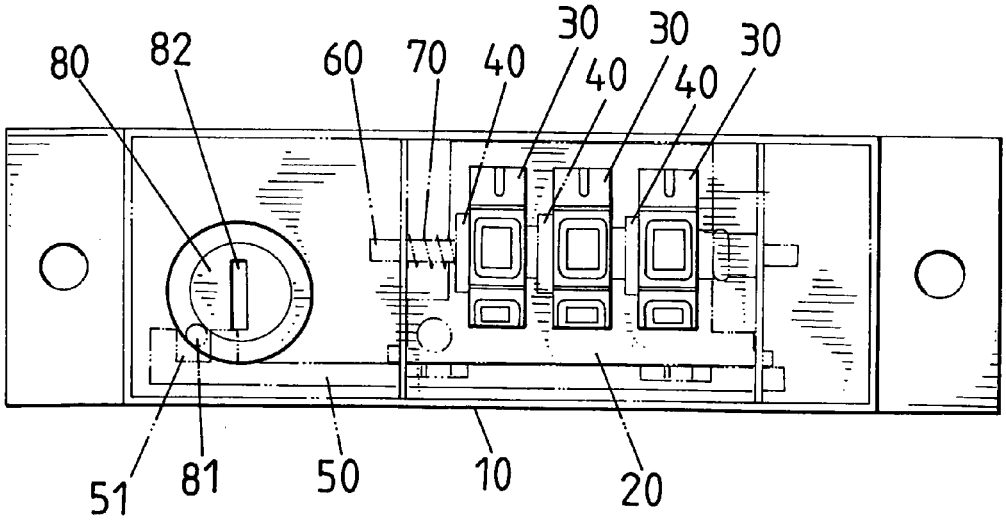
FIG.2
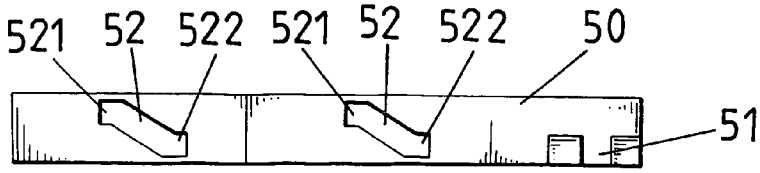
FIG.2~1

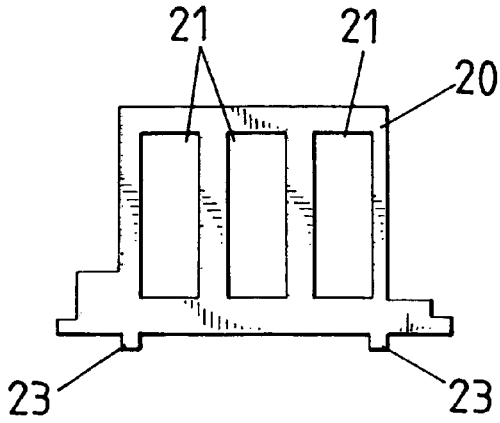
FIG.2~2
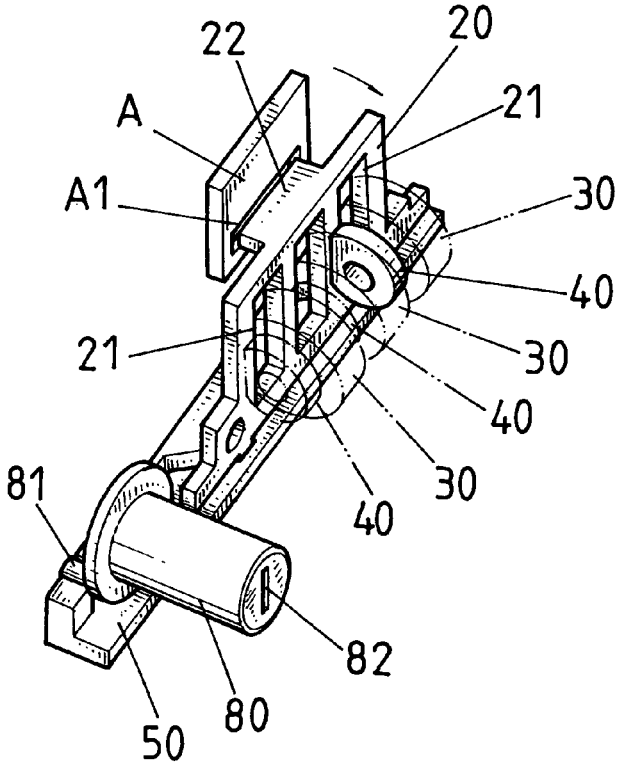
FIG.3
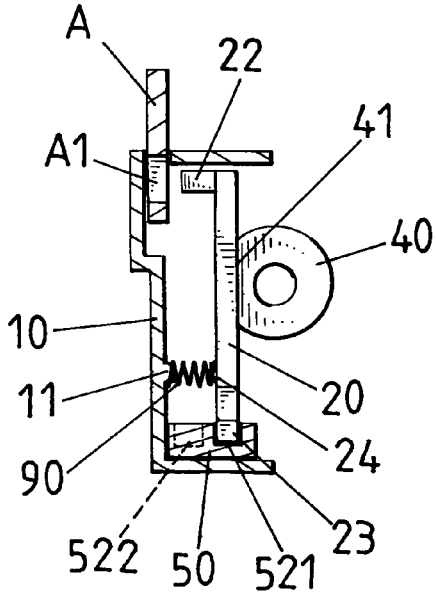
FIG.3~1

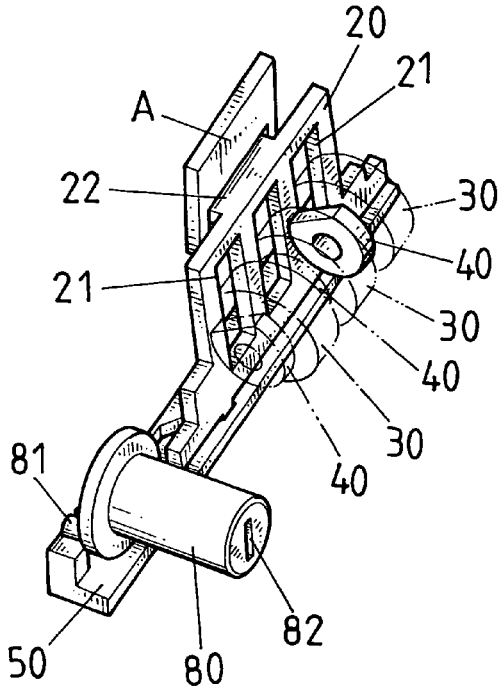
FIG.4
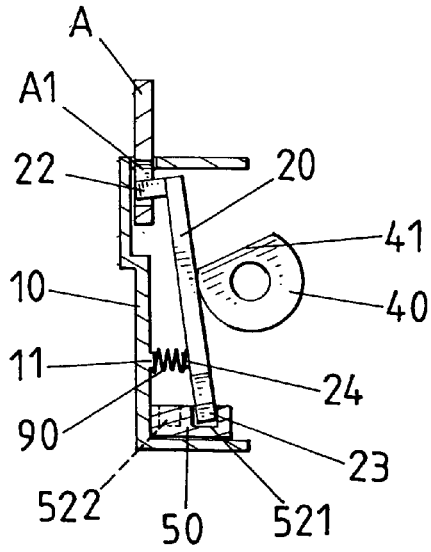
FIG.4~1

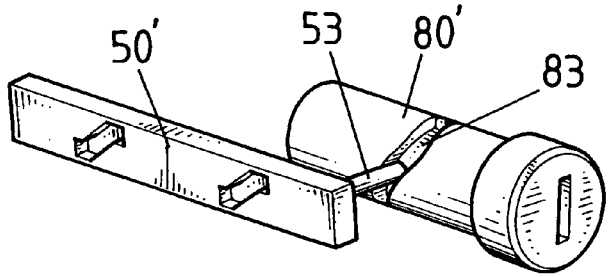
FIG.6
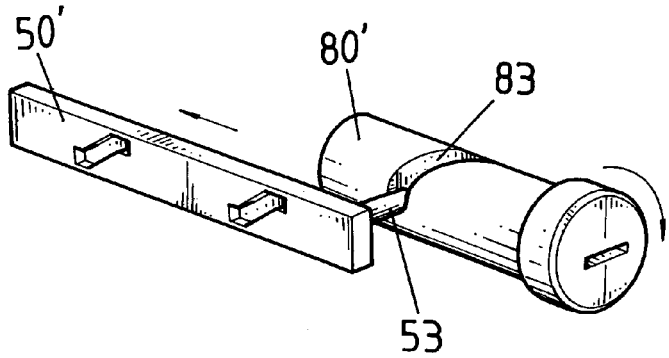
FIG.6~1
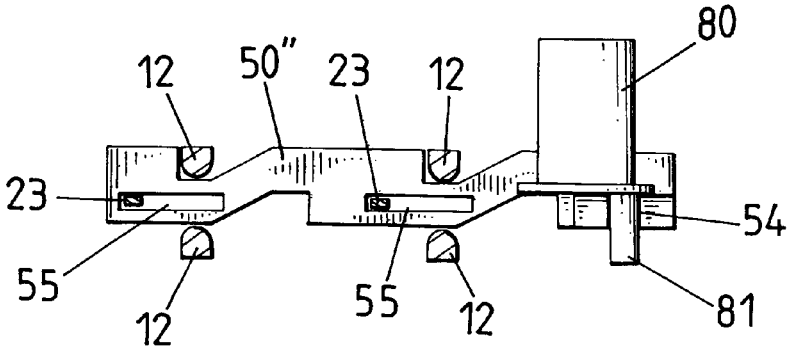
FIG.7
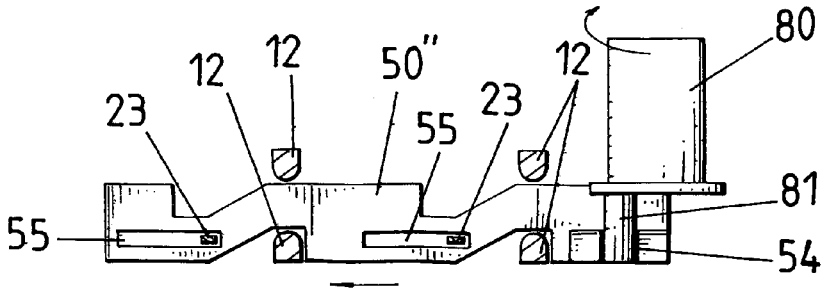
FIG.7~1

SUITCASE LOCK THAT CAN BE OPENED EITHER BY SETTING A COMBINATION OR BY A KEY

BACKGROUND OF THE INVENTION (a) Field of the Invention

The present invention relates to a suitcase lock that can be opened either by setting a combination or by a key, and more particularly to a traditional suitcase dial lock in which is installed an additional key tumbler device, which not only enables using dials to open and close the lock, a key can also be used to rotate the key tumbler to force unlocking, thereby providing the present invention with double effectiveness.

(b) Description of the Prior Art

Referring to FIG. 1, which shows a conventional suitcase dial lock, wherein a swing plate 200 is installed within a housing 100, and three dials 300 are fitted to the swing plate 200. Sleeves 301 are respectively sleeve joined to the dials 300, whereafter the assembly is sleeve disposed on a shaft 400. Hence, such a conventional suitcase dial lock only uses a correct combination of numbers on the dials to enable opening or closing of the lock, and is not provided with a device to force unlocking, thus, there is a need for improvement.

SUMMARY OF THE INVENTION

The present invention relates to a suitcase lock fitted with a key tumbler and a swing plate, a lower portion of which is provided with tongues that clamp connect to a slider, and a straight groove at one end of the slider enables a push rod of the key tumbler to clamp therein, while another end surface is provided with sloping grooves, and a spring is mounted between a housing and the swing plate. When a combination of numbers on dials are not those to enable opening the lock (that is, a locked state), then a specific key can be used to rotate the key tumbler and displace the slider, thereby displacing the tongues at one end of the swing plate within the sloping grooves of the slider, thus causing the swing plate to tilt in an opposite direction and a stopper at the other end be no longer hooked to a slot of a locked object, and enabling the lock to assume an unlocked state.

To enable a further understanding of said objectives and the technological methods of the invention herein, brief description of the drawings is provided below followed by detailed description of the preferred embodiments.

BRIEF DESCRIPTION OF THE DRAWINGS

FIG. 1 is a top sectional view of a prior art suitcase lock;

FIG. 2 is a top sectional view of the present invention;

FIG. 2-1 is a front elevational view of a slider of the present invention;

FIG. 2~2 is a front elevational view of a swing plate of the present invention;

FIG. 3 is a partial elevational view of the present invention when in an unlocked position, swing plate is at the first angle, an open combination on dials;

FIG. 3~1 is a partial structional view of the present invention when in an unlocked position, swing plate is at the first angle, an open combination on dials;

FIG. 4 is a schematic view of the present invention when in a locked position, swing plate is at the second angle, a locking combination on dials;

FIG. 4~1 is a partial structural view of the present invention when in a locked position, swing plate is at the second angle, a locking combination on dials;

FIG. 5~1 is a partial structural view of the present invention with the lock opened by a key with a locking combination on dials, the 3rd angle of the swing plate is shown;

FIG. 5~2 is an enlarged view of the circled section "a" in FIG. 5 of the present invention;

FIG. 6 is a partial structional view of the present invention;

FIG. 6~1 is another partial structional view of the present invention;

FIG. 7 is another partial structional view of the present invention; and

FIG. 7~1 is another partial structional view illustrating action of the present invention.

DETAILED DESCRIPTION OF THE PREFERRED EMBODIMENTS

Figure 5:
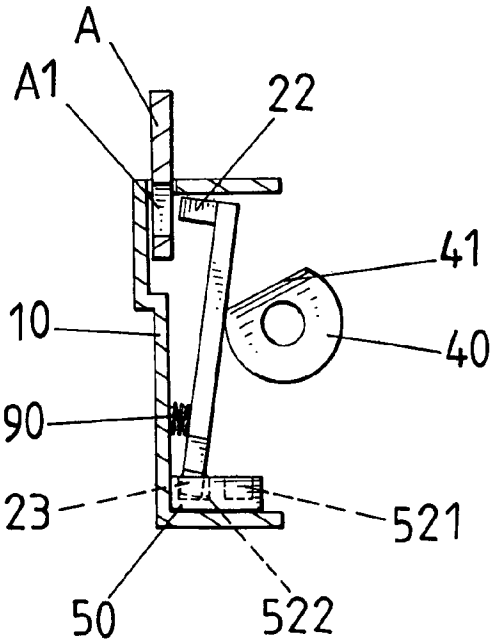
FIG. 5 is a schematic view of the present invention with the lock opened by a key with a locking combination on dials, the 3rd angle of the swing plate is shown.
Figure 5:
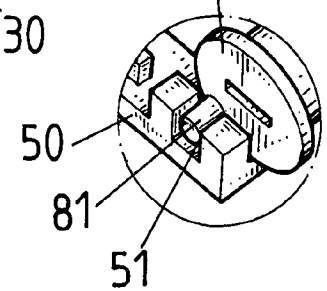
Figure 5:
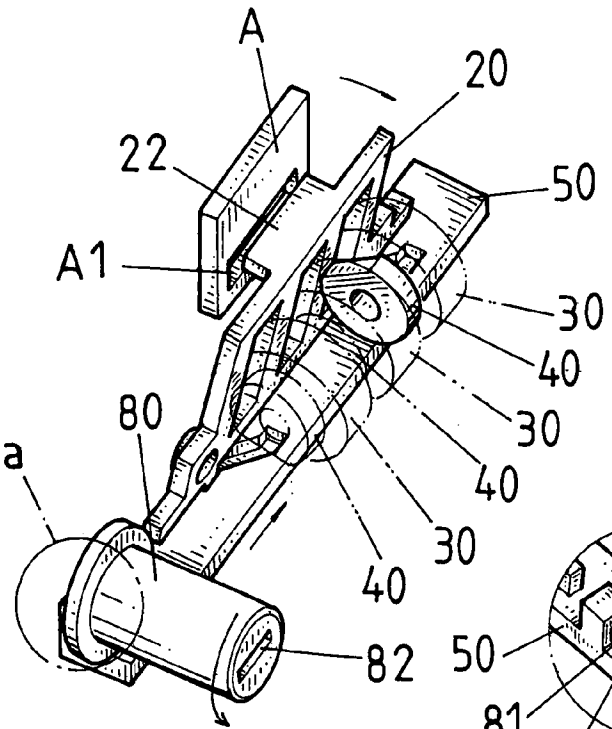

Referring to FIG. 2, which shows the present invention comprising a housing 10, a swing plate 20, three dials 30, three sleeves 40, a slider 50, a shaft 60, a spring 70 and a key tumbler 80, wherein the swing plate 20 is movable relative to the housing 10. Three openings 21 are defined within the swing plate 20, and one end of the swing plate is provided with a stopper 22 (as shown in FIG. 3) and another end is provided with an engagement, which in one embodiment has tongues 23 (as shown in FIGS. 3-1). The three dials 30 are respectively sleeve disposed with the sleeves 40, thereby enabling the shaft 60 to pass therethrough. A rim of each of the sleeves 40 is provided with a cutting 41 (as shown in FIG. 3~1), and teeth provided on an inner side of each of the rims mesh with teeth of an inner ring of each of the dials 30 (not shown in the drawings). When the sleeves 40 and the dials 30 are clamp connected, a portion of each of the rims is exposed, and an inner side of each of me three dials 30 is disposed within the respective three openings 21 of the swing plate 20 (as shown in FIG. 3), thereby enabling outer sides respectively protruding from an outer portion of the housing to facilitate dialing. The spring 70 is sleeve joined to one end of the shaft 60, and the tongues 23 located at a lower portion of the swing plate 20 (as shown in FIG. 2~2) are used to clamp connect to the slider 50, one end of which is provided with a straight groove 51 to enable a drive coupling 81 of the key tumbler 80 to clamp therein. The key tumbler is provided with a key hole 82 to enable a key to be inserted therein.

Referring to FIG. 2~1, the slider 50 is provided with two sloping grooves 52, upper and lower ends of each of which are respectively provided with a transverse upper groove 521 and lower groove 522.

Referring to FIG. 3~1, a spring 90 is fixedly mounted between the housing 10 and spring seats 11, 24 of the swing plate 20.

Referring to FIG. 3~FIG. 5, which show relationship between the slider 50, the swing plate 20 and the key tumbler 80, wherein a portion of the component members, such as the shaft 60, the dials 30, and so on, are not shown in the drawings.

The swing plate 20 of the suitcase lock of the present invention can be positioned at least three angles:

Referring to FIGS. 3 and 3~1, which depict the first angle position of the swing plate 20, wherein when a combination of numbers on the dials 30 are such to enable opening the lock, the cutting 41 of each of the sleeves 40 is disposed flush with an edge of the swing plate 20, and the tongues 23 of the swing plate 20 are positioned within the upper grooves 521 of the slider 50. The swing plate 20 has not yet compressed the spring 90, and the stopper 22 has not yet hooked into a slot A1 of a locked object A, hence, the locked object A can be withdrawn to open the lock or suitcase.

Referring to FIGS. 4 and 4~1, which depict the second angle position of the swing plate 20, wherein when a combination of numbers on the dials 30 are such to place the lock in a locked state (that is, the dials 30 have been rotated to a state that does not allow opening the lock), the cutting 41 of each of the sleeves 40 is deviated to one side, and the circular arc rim abuts against the swing plate 20 while simultaneously compressing the spring 90. The tongues 23 at one end of the swing plate 20 are still positioned within the upper grooves 521 of the slider 50, and the stopper 22 has downwardly hooked into the slot A1 of a locked object A. Thus, the locked object A can not be withdrawn, and the lock is placed in a locked state.

Referring to FIGS. 5 and 5~1, which depict the third angle position of the swing plate 20, wherein when a combination of numbers on the dials 30 have placed the lock in a locked state, a key can be used to rotate the key tumbler 80, whereupon the drive coupling 81, which in one embodiment is a push rod, of the key tumbler 80 is disposed within the straight groove 51 of the slider 50 (as shown in FIGS. 5~2), which displaces the slider, and the tongues 23 at one end of the swing plate 20 are respectively transposed from the upper grooves 521 to the lower grooves 522, thereby causing the swing plate 20 to tilt in the opposite direction from the second angle to the third angle, the stopper 22 is now unhooks the slot A1 of the locked object A, so the lock is placed in an unlocked state.

Referring to FIG. 6, which shows a partial structional view of another embodiment of the present invention, wherein the key tumbler 80' is transversally disposed within the housing 10 in a parallel arrangement with a slider 50'. An arc-shaped groove 83 is defined on the key tumbler 80', and a post 53 longitudinally positioned on the slider 50' is inserted within the groove 83 of the key tumbler 80'. Referring to FIG. 6~1, when a combination of numbers on the dials 30 are such to place the lock in a locked state, a key can be used to rotate the key tumbler 80' to assist displacing the slider 50', and thereby cause the lock to assume an unlocked state.

Referring to FIG. 7, which shows a partial structional view of another embodiment of the present invention; wherein four guiders 12 are located within the housing 10 to fixedly block a slider 50". A straight groove 54 at one end of the slider 50" enables the push rod 81 of the key tumbler 80 to be clamped therein, and an end surface of the slider 50" is provided with two slots 55 to enable the tongues 23 of the swing plate 20 to be respectively disposed therein. Referring to FIG. 7~1, when a combination of numbers on the dials 30 have placed the lock in a locked state, a key can be used to rotate the key tumbler 80 to assist downward and lateral displacement of the slider 50', thereby causing the tongues 23 to respectively displace from one end of the slots 55 to another end thereof, and placing the lock in an unlocked state.

As will be apparent from the foregoing, the suitcase lock of the present invention apart from enabling the dials 30 of the housing 10 to open and close the lock, a key can also be used to rotate the key tumbler 80 to enable force opening of the lock when the dials 30 are in a locked position, thereby providing the present invention with a device that facilitates inspecting contents of a suitcase by a supervisor.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A suitcase lock that can be opened either by setting a combination or by a key, comprising:

a combination lock assembly having a housing;

a plurality of dials, and a swing plate that is movable relative to the housing, the swing plate having a plurality of openings for receiving said plurality of dials, at least one stopper connected to an upper portion of said swing plate, and at least one engagement on a lower portion of said swing plate;

a key tumbler having a drive coupling; and a slider having a first end portion adapted to engage said drive coupling of said key tumbler, and a second end portion adapted to engage with said at least one engagement of said swing plate of said combination lock assembly;

wherein the swing plate may be positioned in at least three angle positions, a first angle position is realized by setting an open combination of numbers on said dials that opens the lock, a second angle position is realized by setting a combination of numbers on said dials that does not open the lock, a third angle position is realized by a key, both the first and third angle positions independently enable releasing a locked object, wherein the engagement of the swing plate is comprised of at least one projecting tongue, with the slider having at least one slot for receiving said at least one tongue of the swing plate.

2. The suitcase lock according to claim 1, wherein said drive coupling has a push rod.

3. The suitcase lock according to claim 2, wherein the slider has a groove at a first end portion thereof for receiving said push rod.

4. The suitcase lock according to claim 1, wherein the second angle position and the third angle position are in opposite directions.

5. A suitcase lock that can be opened either by setting a combination or by a key, comprising:

a combination lock assembly having a housing;

a plurality of dials, and a swing plate that is movable relative to the housing, the swing plate having a plurality of openings for receiving said plurality of dials, at least one stopper connected to an upper portion of said swing plate, and at least one engagement on a lower portion of said swing plate;

a key tumbler having a push rod; and a slider having a first end portion adapted to engage said push rod, and a second end portion adapted to engage with said at least one engagement of said swing plate;

wherein the swing plate may be positioned in at least three angle positions, a first angle position is realized by setting an open combination of numbers on said dials that opens the lock, a second angle position is realized by setting a combination of numbers on said dials that does not open the lock, a third angle position is realized by a key, both the first and third positions independently enable releasing a locked object; and further wherein the engagement of the swing plate is comprised of at least one projecting tongue, with the slider having at least one slot for receiving said at least one tongue of said swing plate and a groove at said first end portion for receiving said push rod, and the second angle position and the third angle position are in opposite directions.

* * * * *